US005433978A

United States Patent [19]

Shield et al.

[11] Patent Number: 5,433,978

[45] Date of Patent: Jul. 18, 1995

[54] METHOD OF MAKING QUASICRYSTAL ALLOY POWDER, PROTECTIVE COATINGS AND ARTICLES

[75] Inventors: Jeffrey E. Shield, Sandy, Utah; Alan I. Goldman, Ames, Iowa; Iver E. Anderson, Ames, Iowa; Timothy W. Ellis, Ames, Iowa; R. William McCallum, Ames, Iowa; Daniel J. Sordelet, Ames, Iowa

[73] Assignee: Iowa State University Research Foundation, Inc., Ames, Iowa

[21] Appl. No.: 127,264

[22] Filed: Sep. 27, 1993

[51] Int. Cl.[6] ..... B22F 9/08

[52] U.S. Cl. ..... 427/456; 75/338; 75/346; 164/46

[58] Field of Search ..... 75/338, 345, 346, 351; 148/403, 404; 164/46; 427/456

[56] References Cited

U.S. PATENT DOCUMENTS

| | | | |
|---|---|---|---|
| 4,347,076 | 8/1982 | Ray et al. | 75/0.5 |
| 4,595,429 | 6/1986 | Le Caer et al. | 148/403 |
| 4,710,246 | 12/1987 | Le Caer et al. | 148/403 |
| 5,294,242 | 3/1994 | Zurecki et al. | 75/345 |

*Primary Examiner*—George Wyszomierski
*Attorney, Agent, or Firm*—Edward J. Timmer

[57] ABSTRACT

A method of making quasicrystalline alloy particulates wherein an alloy is superheated and the melt is atomized to form generally spherical alloy particulates free of mechanical fracture and exhibiting a predominantly quasicrystalline in the atomized condition structure. The particulates can be plasma sprayed to form a coating or consolidated to form an article of manufacture.

14 Claims, 3 Drawing Sheets

METHOD OF MAKING QUASICRYSTAL ALLOY POWDER, PROTECTIVE COATINGS AND ARTICLES

CONTRACTUAL ORIGIN OF THE INVENTION

The United States Government has rights in this invention pursuant to Contract No. W-7405-ENG-82 between the U.S. Department of Energy and Iowa State University, Ames, Iowa, which contract grants to the Iowa State University Research Foundation, Inc. the right to apply for this patent.

FIELD OF THE INVENTION

The present invention relates to a method of making quasicrystal alloys in fine, spherical powder form having a homogenous powder chemistry as well as articles and coatings made therefrom.

BACKGROUND OF THE INVENTION

Certain aluminum-transition metal alloys, such as Al—Cu—Fe, exhibit noncrystallographic rotational symmetries and aperiodic translational order in one, two or three dimensions. These alloys are commonly referred to as quasicrystals, and their structure is neither amorphous nor crystalline. The unique structure and chemistry team to provide high mechanical hardness with good chemical stability. The structure and properties of quasicrystals are described in the Stephens and Goldman article "The Structure of Quasicrystals", *Scientific American*, April, 1991, the teachings of which are incorporated herein by reference with respect to the quasicrystalline structures involved.

Generally, alloy systems represented by Al—Cu—M and Al—Pd—M where M can be virtually any transition metal, such as Fe, Ru, Ni, Mn, Cr or Co, can exhibit quasicrystalline structure. These alloys form the quasicrystalline phase over a range of stoichiometries; for example, such quasicrystalline alloys can comprise about 55–95 atomic % Al, at least about 5 atomic % Cu or Pd, and the balance a transition metal.

To-date, these alloys have been produced in the quasicrystal form by melt spinning, nonconsumable arc melting, or mechanical alloying followed by a high temperature homogenizing heat treatment. These processing routes are plagued with several problems, however., Among these, the most troublesome is associated with the ability of the processing routes to produce only limited quantities of the alloy material. In addition, alloy particulates produced by the melt spinning technique are characterized by a high degree of particle fracture, while alloy material produced by mechanical alloying is characterized by non-uniform composition. The morphology of powder material produced from these precursors is usually very angular and blocky to such an extent that further processing by powder metallurgical techniques or use as a powder feedstock for plasma spraying is rendered difficult.

It is an object of the present invention to provide a method of making quasicrystalline alloys as a fine, spherical powder of homogenous composition for use as a starting material that can be subsequently metallurgically processed free of structural, chemical, and mechanical inhomogeneities.

SUMMARY OF THE INVENTION

The present invention provides a method of making quasicrystalline alloy particulates wherein a melt comprising an alloy having a quasicrystalline phase at ambient temperature is superheated, and the melt is atomized in a manner to form rapidly solidified, generally spherical alloy particulates comprising a quasicrystalline phase.

In one embodiment of the invention, the melt can be atomized using a gas that is inert to the melt and using atomizing gas pressure effective to produce generally spherical particulates having diameters in the range of about 1 to about 100 microns. Preferably, the atomizing gas pressure is about 400 to about 1500 psig depending upon the alloy composition atomized as measured at a gas supply regulator so as to produce particulates having a mean particle size of about 20 to about 30 microns in diameter.

In another embodiment of the invention, the atomized, rapidly solidified, generally spherical, quasicrystalline particulates of the invention optionally are subsequently annealed at a suitable high temperature and time to impart a single-phase quasicrystalline structure thereto. For example, the atomized particulates can be annealed concurrently with a subsequent high temperature powder consolidation operation, such as hot isostatic pressing, to provide the crystal structure.

In still another embodiment of the invention, the atomized, rapidly solidified, generally spherical particulates are plasma or flame sprayed to form a coating comprising a quasicrystalline phase.

In still a further embodiment of the invention, the atomized, rapidly solidified, generally spherical particulates are consolidated, such as by hot isostatic compaction, to form an article comprising a quasicrystalline phase.

In a particular working embodiment of the invention, quasicrystal Al—Cu—Fe alloy particulates are made by superheating a melt of the Al—Cu—Fe alloy in a crucible comprising alumina and to a superheat about 100° to 300° C. above the alloy liquidus, and atomizing the melt using a high pressure inert gas at a pressure of about 400 to 1500 psig measured at the gas supply regulator effective to form spherical alloy particulates having a diameter of about 1 to about 100 microns free of mechanical fracture and exhibiting a predominantly quasicrystalline structure.

DETAILED DESCRIPTION

Figure 1:
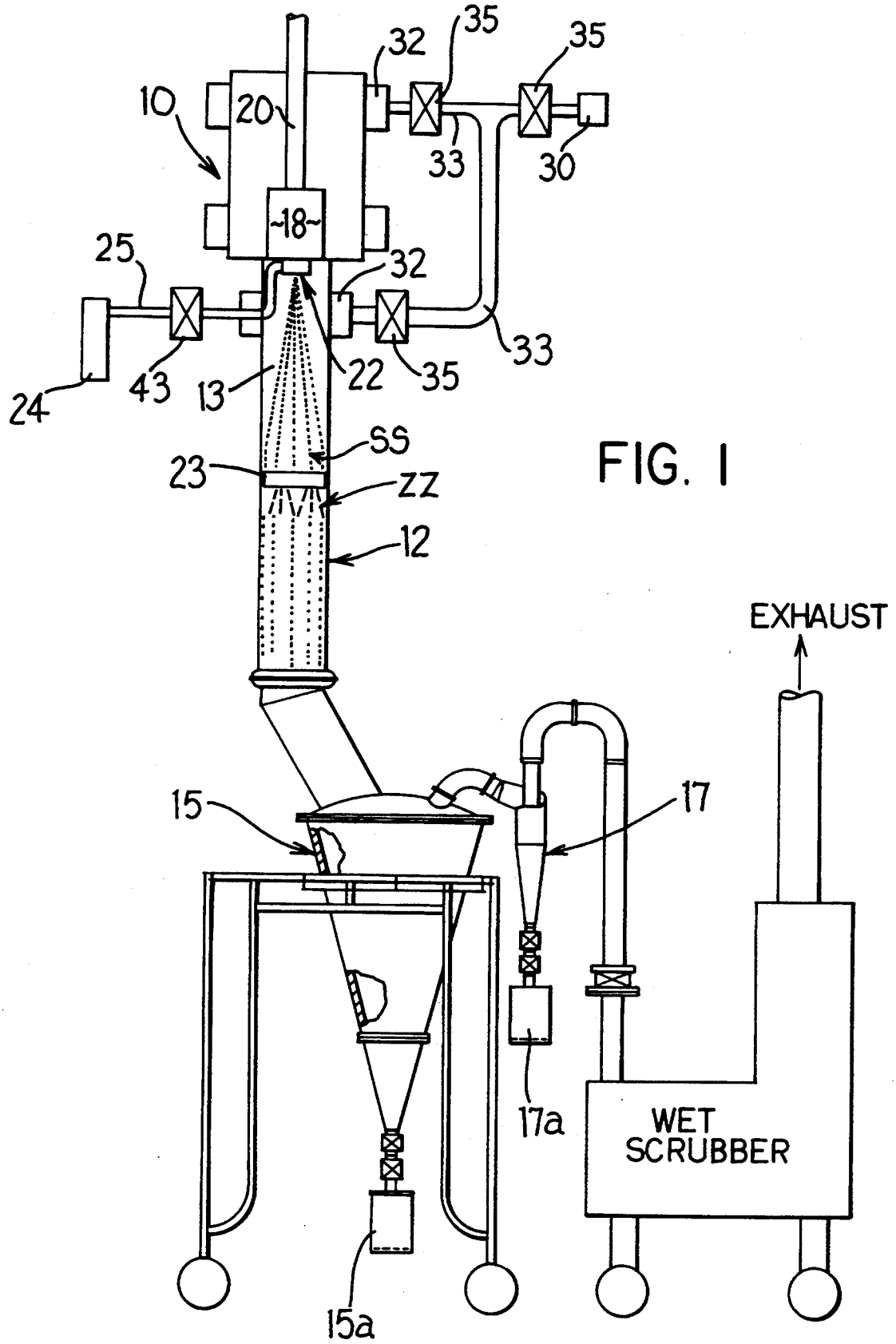
FIG. 1 is a schematic view of high pressure gas atomization apparatus for practicing an embodiment of a method of the invention.

Referring to FIG. 1, a high pressure gas atomization apparatus is shown for practicing one illustrative embodiment of the invention. However, the invention is not limited to high pressure gas atomization of the melt and can be practiced using other gas atomization techniques as well as centrifugal atomization techniques such as wherein a suitable alloy melt is directed onto a rotating disc in a manner to atomize the melt. Further, a rotating rod comprising a suitable alloy can be melted at the rod end during rotation to centrifugally atomize the molten alloy therefrom.

The apparatus of FIG. 1 includes a melting chamber 10 and a drop tube 12 located beneath the melting chamber and defining a atomizing chamber 13. The melting chamber 10 includes an induction melting furnace 18 and a vertically actuated stopper rod 20 for controlling flow of melt from the furnace 18 to a melt atomizing nozzle 22 disposed between the furnace and the atomizing chamber. The atomizing nozzle 22 is supplied with an atomizing gas (e.g. argon).from a suitable source 24, such as a conventional bottle or cylinder of the appropriate gas. The atomizing nozzle 22 atomizes the alloy melt in the form of a supersonic spray SS containing generally spherical, molten droplets of melt discharged into the atomizing chamber 13. The droplets rapidly solidify (e.g. greater than 10,000° C./second) in the atomizing chamber 13 to form powder.

The atomizing nozzle 22 preferably is of the supersonic high pressure gas type described in detail in the Anderson U.S. Pat. No. 5,125,574, the teachings of which are incorporated herein by reference. The atomizing nozzle 22 is supplied with an atomizing gas through a conduit 25 and open/close valve 43. As shown in FIG. 1, the atomizing nozzle 22 atomizes the melt in the form of a supersonic spray SS containing generally spherical, molten droplets of melt discharged into the atomizing chamber 13. The droplets solidify quite rapidly in the atomizing chamber 13 to form generally spherical powder.

Both the melting chamber 10 and atomizing chamber 13 are connected to an evacuation device (e.g. vacuum pump) 30 via suitable ports 32 and conduits 33. Prior to melting and atomization of the melt, the melting chamber 10 and atomizing chamber 13 are evacuated to a level of $10^{-4}$ atmosphere to substantially remove ambient air. Then, the evacuation system is isolated from the chambers 10, 13 via the valves 35 and the chambers 10, 13 are positively pressurized by an inert gas (e.g. argon to about 1.1 atmosphere) to prevent entry of ambient air thereafter.

In practicing the method of the invention, the drop tube 12 can have a generally circular cross-section of one foot diameter and a length of ten feet.

The powder produced in the atomizing chamber 13 is separated from the gas stream and collected in a collector system comprising a primary conical collector 15 having a powder collection container 15*a* and a secondary cyclone collector 17 also having a powder collector container 17*a*. The gas stream then passes through a wet scrubber before being exhausted to the atmosphere. The collector system comprising the primary collector 15 and the secondary collector 17 is described in allowed copending application entitled "POWDER COLLECTION APPARATUS/METHOD" Serial No. 07/997 725, of common assignee herewith. The powder produced in the atomizing chamber 13 can also be collected in the manner described in the aforementioned Anderson U.S. Pat. No. 5,125,574 incorporated herein by reference.

The method of the invention will be described herebelow for purposes of illustration, not limitation, with respect to manufacture of a rapidly solidified quasicrystalline Al—Cu—Fe alloy powder comprising, in atomic % Al-65% Cu-23% and Fe-12% (Al-37.6 weight % Cu-17.25 weight % Fe). However, the invention is not limited to this specific alloy powder composition and can be practiced to make other Al—Cu—Fe alloy powder compositions exhibiting a quasicrystalline structure. Moreover, more broadly, the invention can be practiced to make other quasi-crystalline alloy atomized powders. For example, the invention can be practiced to make predominantly quasicrystalline atomized powder comprising aluminum-transition metal alloys, including Al—Cu—M, Al—Pd—M where M is a transition metal such as Fe, Ru, Ni, Mn, Cr, or Co, and other ternary, quaternary and higher alloys having stoichiometries providing quasicrystalline structures. A small amount (e.g. up to about 10 atomic %) of a transition metal, such as Ti, V, Cr, Mn, Co, Ni, Ta, W, Nb, Mo and Zr or, alternately or in addition, a small amount of B or Si can be provided in the aforementioned Al—Cu—M and Al—Pd—M alloys to form quaternary and higher alloys without loss of quasicrystalline phase. For example, a small amount (e.g. up to about 10 atomic %) of Cr can be added to the Al—Cu—Fe alloy while maintaining the quasicrystalline phase. The amount of transition metal included will be dependent on its affect on the quasicrystalline structure, however.

A charge of elemental Al, Cu, and Fe was placed in a high purity, coarse grain alumina crucible disposed within the melting furnace 18 described hereabove. The elemental charge components were present in amounts of 37.6 weight % Cu (564 grams), 17.25 weight % Fe (258.75 grams), and the balance 45.15 weight % Al (677.25 grams) so as to yield an alloy melt comprising, $Al_{65}Cu_{23}Fe_{12}$, having a melting temperature of about 1100° C. The charge components aggregated 1500 grams in weight. The Cu charge component comprised electronic grade (CDA 101) copper. The Fe charge component comprised electrolytic "Glidden" iron flake. The Al charge component comprised Al nodules of commercial purity.

Prior to melting of the charge, the melting chamber 10 was initially evacuated to $30\times10^{-3}$ Torr and then backfilled with ultra high purity argon to 1.1 atmosphere. The charge components were induction heated and melted to alloy them prior to atomization to promote good melt homogeneity and to provide a melt temperature of 1100° C., corresponding to a melt superheat of 230° C. above the alloy liquidus temperature of 870° C. The melt was maintained at 1100° C. for 2 minutes to stabilize the melt temperature and to homogenize the molten alloy.

Although a specific melt superheat of 230° C. was employed for the $Al_{65}Cu_{23}Fe_{12}$ alloy, the invention is not so limited and can be practiced using melt superheats in the range of about 100° to about 300° C. above the alloy liquidus temperature generally for quasicrystal Al—Cu—Fe alloys.

Once the melt temperature was stabilized at 1100° C. for 2 minutes, the stopper rod 20 (high purity, fully dense alumina) was raised to release the melt for flow (flow rate of 65 grams/second) through a machinable alumina melt supply tube for atomization by the high pressure argon gas jets of the atomizing nozzle 22 described in aforementioned U.S. Pat. No. 5,125,574 incorporated herein by reference. The superheated melt was atomized using ultra high purity argon gas at a pressure of 1100 psig as measured at the gas regulator of supply 24.

Although a specific atomizing gas pressure of 1100 psig was employed for the $Al_{65}Cu_{23}Fe_{12}$ alloy at the superheat described hereabove, the invention is not so limited and can be practiced using an inert atomizing gas pressure of about 400 to about 1500 psig generally for quasicrystal Al—Cu—Fe alloys.

The atomized melt was discharged from the atomizing nozzle 22 into the atomizing chamber 13 of the drop tube 12 for rapid solidification of the molten atomized alloy droplets. The atomized droplets passed through a reaction zone ZZ of ultra high purity nitrogen established about 20 inches downstream of the atomizing nozzle 22 in the chamber 13 by an annular reactive gas distribution manifold or pipe 23, see FIG. 1, in accordance with aforementioned Anderson U.S. Pat. No. 5,125,574, incorporated herein by reference. Passage of the atomized droplets through the nitrogen reaction zone Z results in formation of a protective nitride layer on the atomized Al—Cu—Fe powder particles that renders them non-reactive in a spark test described in the aforementioned Anderson patent.

Figure 2:
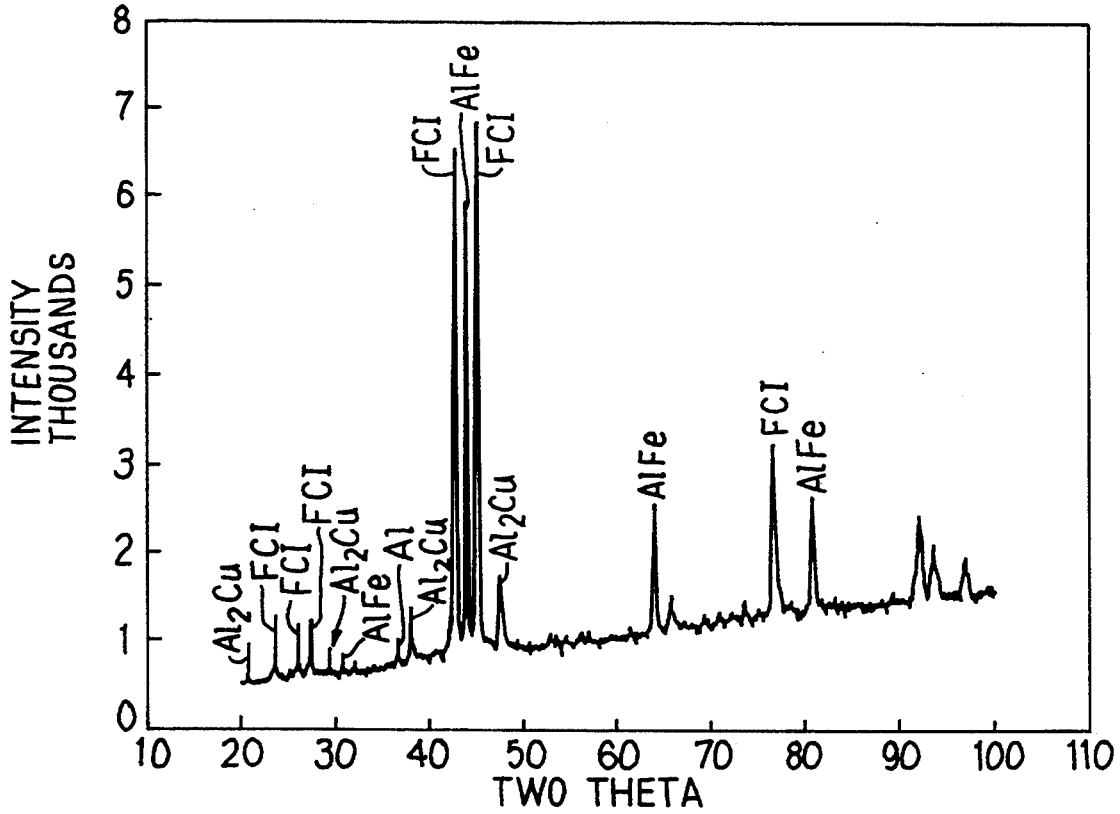
FIG. 2 is an X-ray diffraction pattern of $Al_{65}Cu_{23}Fe_{12}$ alloy powder produced in accordance with the invention.

The atomized melt discharged to the atomizing chamber 13 was collected in the manner described in the aforementioned Anderson patent and analyzed. The yield of atomized powder was greater than 90% of the starting melt amount. The collected atomized powder was analyzed by X-ray diffraction to determine particle crystal structure. The X-ray diffraction pattern of FIG. 2 reveals that the atomized powder particles exhibited a predominantly quasicrystalline structure.

Figure 3:
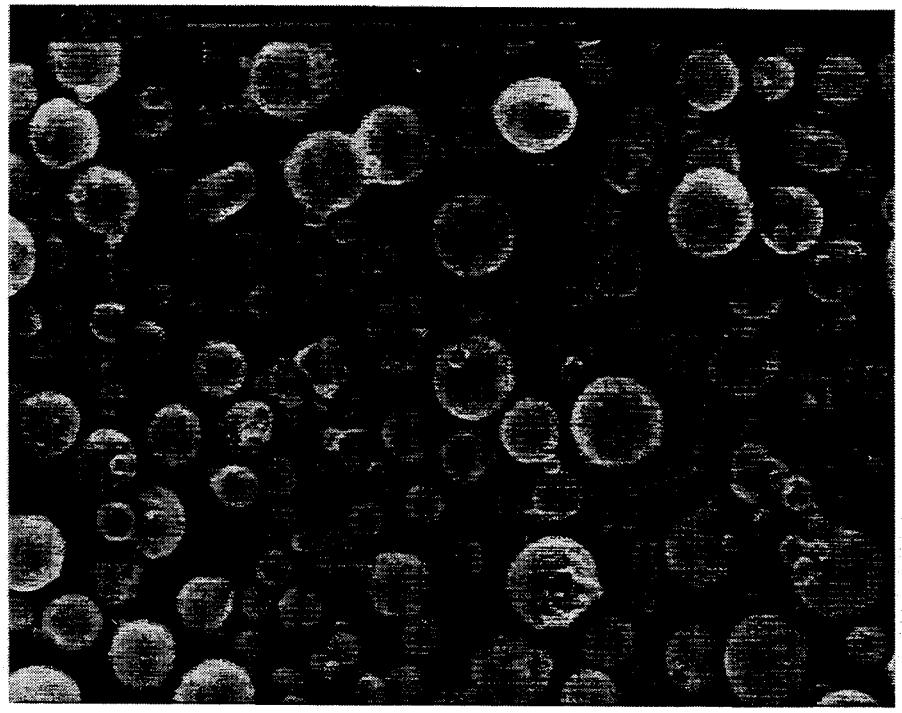
FIG. 3 is a backscattered scanning electron micrograph of $Al_{65}Cu_{23}Fe_{12}$ powder particulates produced in accordance with the invention.

The collected atomized powder also exhibited a generally spherical morphology, FIG. 3, freedom from mechanical fracture and a particle size of about 1 to about 100 microns in diameter as determined by scanning electron microscopy. The majority of the powder particles were less than 38 microns in diameter. The mean particle size of the atomized powder was determined to be about 20 to about 30 microns.

The atomized alloy particulates can be subsequently annealed at a suitable high temperature (e.g. 800° C. for 20 days), to impart a single phase quasicrystal structure to the particulates; i.e, to thermally convert the microstructure completely to a single-phase quasicrystalline structure. For example, the atomized particulates can be annealed as part of a subsequent high temperature powder consolidation operation, such hot isostatic pressing, to provide the quasicrystal structure. Alternately, the powder can be separately annealed to this end, if desired.

The quasicrystalline, generally spherical powder particulates of the invention made by the atomization of the melt are ideal as a starting material for conventional powder metallurgical techniques, e.g., hot isostatic pressing for the production of monolithic bodies or components or as an addition to mixed elemental or alloy powders prior to consolidation. For example, the aforementioned atomized $Al_{65}Cu_{23}Fe_{12}$ powder having a size less than 44 microns was hot isostatically pressed at 800° C. and 45 ksi for 4 hours in a container to produce a consolidated article having quasicrystalline phase and (Fe—Al) phase.

The flowability of the spherical atomized alloy particles will be of benefit in the production of plasma or flame sprayed protective coatings of these alloys on substrates. In particular, the generally spherical atomized alloy particles will provide a uniform feed rate and melting rate through a spray torch assembly to aid in producing a more consistent surface coating.

For purposes of illustration and not limitation, atomized, generally spherical, predominantly quasicrystalline powder comprising 68 atomic % Al, 23 atomic % Cu and 9 atomic % Fe was high pressure gas atomized in the manner described hereabove for the $Al_{65}Cu_{23}Fe_{12}$ quasicrystalline alloy. The atomized $Al_{68}Cu_{23}Fe_9$ powder in the size range from −75 microns to +25 microns diameter (i.e. less than 75 microns to greater than 25 microns diameter) was used as feedstock for ambient atmosphere plasma arc spraying using a commercially available Miller Thermal SG-100 gun (available from Miller Thermal of Appleton, Wis.) arranged in a 40 kw, subsonic mode and having an anode with Miller Thermal designation 145, cathode with Miller Thermal designation 129, and gas injector with Miller Thermal designation 113. The plasma arc spraying parameters were as follows:

| | |
|---|---|
| Current: | 850 amperes |
| Voltage: | 39 volts |
| Arc Gas: | 80 psi argon |
| Auxiliary Gas: | 120 psi helium |
| Powder Gas: | 40 psi argon |
| Powder Feed rpm: | 3.0 rpm |
| Stand-Off Distance: | 4 inches |

The plasma sprayed coating was applied to a Al alloy substrate to a thickness of 1.5 millimeters. Hardness measurements were made on a polished cross-section of the coating using a 25 gram load with a Vickers microindenter. The measured coating hardness was $H_{v(0.025)}$, approximately equal to 775±50.

The atomized $Al_{68}Cu_{23}Fe_9$ powder feedstock Was analyzed by X-ray diffraction and indicated primarily face-centered icosahedral (FCI) quasicrystalline phase with small amounts of (Fe—Al), $Al_2$ Cu and Al phases. Similar X-ray diffraction and analysis of the $Al_{68}Cu_{23}Fe_9$ plasma arc sprayed coating indicated a two-phase coating comprising FCI phase and (Fe—Al) phase.

The present invention is advantageous for producing large quantities of the spherical atomized quasicrystal alloy powder including aluminum-transition metal and other alloys having predominantly quasicrystalline structure, chemical homogeneity and freedom from mechanical fracture in a relatively low cost manner for the various uses mentioned. Such atomized alloy powder can find use in fabrication of bearing materials, corrosion resistant components, high stiffness structural components, and other components and articles of manufacture in monolithic or composite forms.

While the invention has been described in terms of specific embodiments thereof, it is not intended to be limited thereto but rather only to the extent set forth in the following claims.

The embodiments of the invention in which an exclusive property or privilege is claimed are defined as follows:

1. A method of making quasicrystalline aluminum-transition metal alloy particulates, comprising, providing in a vessel a superheated, compositionally homogenous alloy melt comprising aluminum and a transition metal and having a quasicrystalline phase at ambient temperature, discharging the melt from the vessel, and gas atomizing the superheated melt to form generally spherical alloy particulates comprising a quasicrystalline phase.

2. The method of claim 1 wherein said providing step comprises melting elemental Al and elemental transition metal in a crucible to form a homogenous melt.

3. The method of claim 1 wherein the melt super-heat is about 100° to about 300° C. above the alloy liquidus.

4. The method of claim 1 wherein the melt is atomized using an atomizing gas effective to produce generally spherical particulates.

5. The method of claim 4 wherein the atomizing gas pressure is about 400 to about 1500 psig as measured at a supply regulator.

6. The method of claim 1, wherein the particulates have a mean particle size of about 20 to about 30 microns in diameter.

7. The method of claim 1 further including heating the atomized particulates at a temperature for a time effective to provide a substantially single phase quasicrystalline structure.

8. The method of claim 1 including the further step of plasma spraying the particulates onto a substrate to form a coating thereon.

9. A method of making quasicrystalline aluminum-transition metal alloy particulates comprising, providing in a vessel a superheated, compositionally homogenous melt comprising the aluminum-transition metal alloy superheated to about 100° to about 300° C. above the alloy liquidus, discharging the melt from the vessel, and gas atomizing the superheated melt using an inert gas at a pressure of about 400 to 1500 psig measured at a gas supply regulator effective to form generally spherical alloy particulates comprising a quasicrystalline phase.

10. The method of claim 9 wherein said providing step comprises melting elemental Al and elemental transition metal in a crucible to form a homogenous melt.

11. The method of claim 9 wherein the particulates have a mean particle size of about 20 to about 30 microns in diameter.

12. The method of claim 9 further including heating the atomized particulates at a temperature for a time effective to provide a substantially single phase quasicrystalline structure.

13. The method of claim 9 including the further step of plasma spraying the particulates onto a substrate to form a coating thereon.

14. A method of making quasicrystalline Al—Cu—Fe alloy particulates, comprising the steps of providing in a crucible a superheated, compositionally homogenous melt of the Al—Cu—Fe alloy superheated to about 100° to about 300° C. above the alloy liquidus, discharging the melt from the crucible, and gas atomizing the superheated melt using an inert gas at a pressure of about 400 to about 1500 psig measured at a gas supply regulator effective to form generally spherical alloy particulates having a diameter of about 1 to about 100 microns and a quasicrystalline phase.

* * * * *